US005904304A

United States Patent [19]

Marra et al.

[11] Patent Number: 5,904,304

[45] Date of Patent: May 18, 1999

[54] APPARATUS AND METHOD FOR FIBERIZING SOLID WOOD BLOCKS

[75] Inventors: Alan A. Marra, Amherst, Mass.; Vic Marra, Webster, N.Y.

[73] Assignee: Alan A. Marra, Amherst, Mass.

[21] Appl. No.: 09/082,807

[22] Filed: May 21, 1998

[51] Int. Cl.[6] ..... B02C 18/06

[52] U.S. Cl. ..... 241/27; 241/28; 241/92; 241/273.2; 241/278.1; 144/176; 144/373

[58] Field of Search ..... 241/28, 92, 273.2, 241/278.1, 281, 27; 144/176, 373

[56] References Cited

U.S. PATENT DOCUMENTS

| | | | |
|---|---|---|---|
| 2,154,650 | 4/1939 | Wishinsky . | |
| 2,388,799 | 11/1945 | Payzer et al. . | |
| 2,537,570 | 1/1951 | Bossert . | |
| 2,655,319 | 10/1953 | Johnson . | |
| 3,462,089 | 8/1969 | Whitlow . | |
| 3,489,356 | 1/1970 | Combs et al. . | |
| 3,661,331 | 5/1972 | Ballew | 241/92 |
| 3,746,062 | 7/1973 | Nystrom et al. . | |
| 4,122,236 | 10/1978 | Holman . | |
| 4,184,526 | 1/1980 | Hanaya | 144/235 |
| 4,660,778 | 4/1987 | Fischer et al. . | |
| 5,211,688 | 5/1993 | Rice, Sr. | 144/373 |
| 5,469,901 | 11/1995 | Leguin | 241/278.1 X |
| 5,649,578 | 7/1997 | Leguin | 241/278.1 X |

*Primary Examiner*—John M. Husar
*Attorney, Agent, or Firm*—Ian C. McLeod; Mary M. Moyne

[57] ABSTRACT

An apparatus (10) having a rotating fiberizing disc (26, 226 or 326) for fiberizing wood blocks (100) to produce fibrous elements is described. The apparatus includes a housing (12) within which is mounted the disc. The disc is provided with a series of rows (32, 232 or 332) of teeth (28, 228 or 328) on the front planar face (26A, 226A or 326A) as well as a scraper (30, 230 or 330). The wood block is advanced to the face of the disc in a manner such that its long grain direction can be controlled at various angles with respect to the path of the circularly travelling teeth and thereby changing the nature of the resulting fibrous elements.

20 Claims, 4 Drawing Sheets

APPARATUS AND METHOD FOR FIBERIZING SOLID WOOD BLOCKS

BACKGROUND OF THE INVENTION

Field of the Invention

The present invention relates to a disc for disintegrating a solid wood block to produce fibrous strands or elements for use in making composites. In particular, the present invention relates to a disc which has teeth formed in rows which contact the wood block to shred the wood block to produce fibrous elements. The disc is also provided with a scraper which completely detaches fibrous elements from the wood block. The wood block is fed into the disc such that the teeth of the disc strike the wood block in a circular path along the preferred grain direction of the wood block.

In the lexicon of the smaller wood elements derivable from wood, the terms: flake, strand, splinter, sliver, fiber-bundle and fiber are associated with definite products into which they are composed. Each element contributes characteristics to the composite and to its processing in accordance with the element's geometry. The fibrous strand or fibrous element is a combination element being composed of both a strand-like element and fiber-like elements. The strand part may be straight but is usually bent or curved. The fibrous parts are partially cleaved appendages that branch off in random directions from the strand part.

Fibrous strands, like other wood elements, can be produced and have utility over a wide range of sizes. Fibrous strands are three-dimensional particles, compared to two-dimensional flakes, and one-dimensional slivers or splinters. Strands (actually narrow flakes) as used in Oriented Strand Boards (OSB) are strictly speaking, two-dimensional but are used in a one-dimensional manner (oriented) to create strength in a given direction.

The three-dimensional configuration of the fibrous strand contributes uniquely to its further processing and to the properties of the resulting composite material. Unlike flakes and other linear or flat elements that depose themselves parallel to the surface upon which they fall, fibrous strands assume a more random orientation. Thus, flakes contribute strength primarily in the x-y plane, leaving the z plane relatively weak. Fibrous strands, however, because of their more random orientation, produce substantially greater strength in the z planes. The z plane figures heavily in the performance of overlays and in the general integrity of the composite material.

Fibrous strands also compose themselves into a rather open but cohesive mat. Such a mat is easy to transport between operations, is easily infused with gases, liquids and powders, has less edge defects in pressing, produces strength perpendicular to faces, (high internal bond) and allows low, as well as high density composite materials to be made.

The three-dimensional configuration of fibrous strands confers versatility in consolidation to many types of products. Flat, molded or post-formed commodities or consumer products can be made, sometimes with the same composition. Properties are related to density which can range from about 8 pounds per cubic foot upward, depending upon the pressure applied during consolidation.

Fibrous strands can be produced either by impact milling or by shredding directly from stove-wood size blocks. Both methods produce suitable fibrous strands. One method of impact milling is described in Applicant's co-pending application entitled "Controlled Impact Comminution of Wood". This type of milling necessitates some prior preparation of the wood such as maxi-chipping, crushing, steaming or conditioning to appropriate moisture content.

In contrast, the shredding of stove-wood size blocks as described in the present application requires only chain-sawing to block size and perhaps some splitting to fit the feed opening of the apparatus. The block is held against an arrangement of teeth that are driven ever the face of the wood in a manner that partly shears and partly tears out the fibrous strands. Since the separating forces acting on the parent wood block are more precisely controlled than in impact milling, the resulting wood element has more uniformity and more precise dimensions. For the same reason, wood elements of similar configuration can be produced using different species of wood, an advantage with variable resources.

(2) Description of the Related Art

The apparatus of the present invention is related mechanically and structurally to such equipment as disc flakers that produce flakes for flakeboard by knife action and disc chippers that produce chips also by knife action for further reduction to fibrous elements by attrition mills that provide rolling shear action.

The present invention produces fibrous strands directly from solid wood blocks without the intermediate step of first producing chips. By advancing a wood block in a controlled grain direction against a rotating disc studded with precisely configured and sequentially deployed teeth followed by a scraper action, fibrous strands are extracted from the parent wood block.

The related art has shown various types of discs having knives providing radially disposed knife action for disintegrating wood blocks to produce chips for further processing. Illustrative are U.S. Pat. No. 2,388,799 to Payzer et al; U.S. Pat. No. 2,655,319 to Johnson and U.S. Pat. No. 3,746,062 to Nystrom et al.

Payzer et al describes a wood chipper disc which has an annular series of elongated radial openings within which are mounted chipper blades for the purpose of cutting pulp chips from the end of logs by across-the-grain cutting action.

Nystrom et al shows a wood chipper disc which has a plurality of cutting element holders located adjacent a hole. The cutting element holders are arranged at a number of concentrical circular lines. A second disc is mounted spaced apart and behind the first disc to provide rigidity.

Johnson shows a wood chipper with knives routed in a radial fashion on the face of the disc. The invention uses a non-uniform knife bevel as a means of producing better paper-making chips from logs fed end-wise with the knives cutting across the end grain of the wood.

Also of interest are U.S. Pat. No. 2,537,570 to Bossert; U.S. Pat. No. 3,462,089 to Whitlow; and U.S. Pat. No. 4,122,236 to Holman. Bossert shows a pair of grinding discs which are arranged face to face. The grinding surface of the discs are provided with a plurality of recesses and pockets. The solid particles, to be ground, are trapped in the recesses and pockets of each disc. The solid particles of the material in the recesses and pockets of each disc are ground by the solid particles in the recesses and pockets of the other disc and are sheared by the knife-like edges of such recesses and pockets. Whitlow shows a disc for refining chips to a pulp slurry. The face plate of the disc is comprised of a plurality of arcuate segments. The segments include a plurality of upstanding, relatively radially short teeth in the form of ridges between which are disposed a plurality of upstanding, relatively radially long teeth in the form of ridges. Both teeth are provided with sharp edges. Holman shows the use of an across-the-grain picking action to produce splints from a log.

Only of minimal interest are U.S. Pat. No. 2,154,650 to Wishinsky; U.S. Pat. No. 3,489,356 to Combs et al and U.S. Pat. No. 4,660,778 to Fischer at al. Wishinsky shows a vegetable grater in the form of a rotating disc having scoring members and scraping blades. The scorers and blades are positioned in groups so that each group defines a quadrant of the disc with the blades in any group being parallel to a straight edge boundary of the quadrant they occupy and perpendicular to the blades in an adjoining quadrant. Combs et al describes an impeller for mounting in a slurry tank for pulping slurry solids. Fischer et al shows an impeller disc for use in size reducing a food product. The disc has a plurality of blades which are of the same length and which are alternately displaced upwardly and downwardly with the upwardly displaced blades having forwardly inclined product-engaging surfaces and the downwardly displaced blades having rearwardly inclined product-engaging surfaces.

There remains the need for an apparatus which can be used to produce fibrous strands or elements from solid wood blocks. The fiberizing disc of the present invention having a plurality of teeth mounted in several rows on the disc provides a means of producing fibrous elements from solid wood blocks. The positioning of the teeth on the disc and the direction of feed of the wood block allows the teeth on the disc to strike the wood block in a circular path along the preferred grain of the wood block. In addition, a scraper on the disc allows for completely detaching fibrous elements from the wood block. The construction of the disc allows the creation and extraction of fibrous elements from a solid wood block in a controllable manner.

OBJECTS

It is therefore an object of the present invention to provide a wood fiberizing disc which will produce fibrous elements from a wood block suitable for use in producing composite products. Further, it is an object of the present invention to provide a wood fiberizing disc which produces a variety of different forms of fibrous elements from solid wood blocks. Still further, it is an object of the present invention to provide a wood fiberizing disc having a plurality of teeth arranged such that each tooth functions relatively independently but cooperatively in forming and extracting fibrous elements from the wood block. Further still, it is an object of the present invention to provide a wood fiberizing disc which has a scraper for completely detaching fibrous elements from a wood block. Further still, it is an object of the present invention to provide a fiberizing disc which allows for inexpensive, easy, quick and controlled production of fibrous elements from wood blocks ultimately helping to address the problem of sustainability and biodiversity in forest resources by adding more value to low grade wood. It is further an object of the present invention to provide a means for the profitable utilization of wood unwanted or wasted because of species, size, form or distribution to thereby increase forest management options without decreasing the flow of forest products.

These and other objects will become increasingly apparent by reference to the following drawings and the description.

DETAILED DESCRIPTION OF THE PREFERRED EMBODIMENTS

The present invention relates to an improved disc for comminuting a wood block to produce fibrous elements having a planar face and journaled for rotation, the improvement which comprises: a plurality of teeth protruding from the planar face of the disc which engage a surface of the wood block to produce fibrous elements, the teeth arranged in at least one row on the planar face of the disc; and a scraper positioned on the planar face of the disc so as to remove fibrous elements from the surface of the wood block.

Further, the present invention relates to an apparatus which comprises: a rotatable disc with a planar face which is journaled for rotation and having teeth extending from the planar face which engage a surface of a wood block in a circular path to produce fibrous elements as the disc rotates with the teeth arranged in at least one row an the planar face of the disc and having a scraper which sweeps fibrous elements from the surface of the wood block; and feed means mounted adjacent the rotatable disc which directs the wood block against the face of the disc so that the teeth engage the surface of the wood block in a circular path.

Still further, the present invention relates to a method for producing fibrous elements from wood blocks, which comprises: providing an apparatus which comprises: a rotatable disc with a planar face which is journaled for rotation and having teeth extending from the planar face which engage a surface of a wood block in a circular path to produce fibrous elements as the disc rotates, the teeth arranged in at least one row on the planar face of the disc and having a scraper which sweeps fibrous elements from the surface of the wood block; feed means mounted adjacent to the rotating disc which directs the wood block against the face of the disc so that the teeth engage the surface of the wood block in a preset manner; and introducing the wood blocks into the apparatus so that the surface of the blocks engages the teeth on the planar face of the disc with the teeth moving in a circular path on a preset grain direction of the wood block to produce fibrous elements and the scraper engages the surface of the wood blocks to remove fibrous elements from the wood block.

Figure 1:
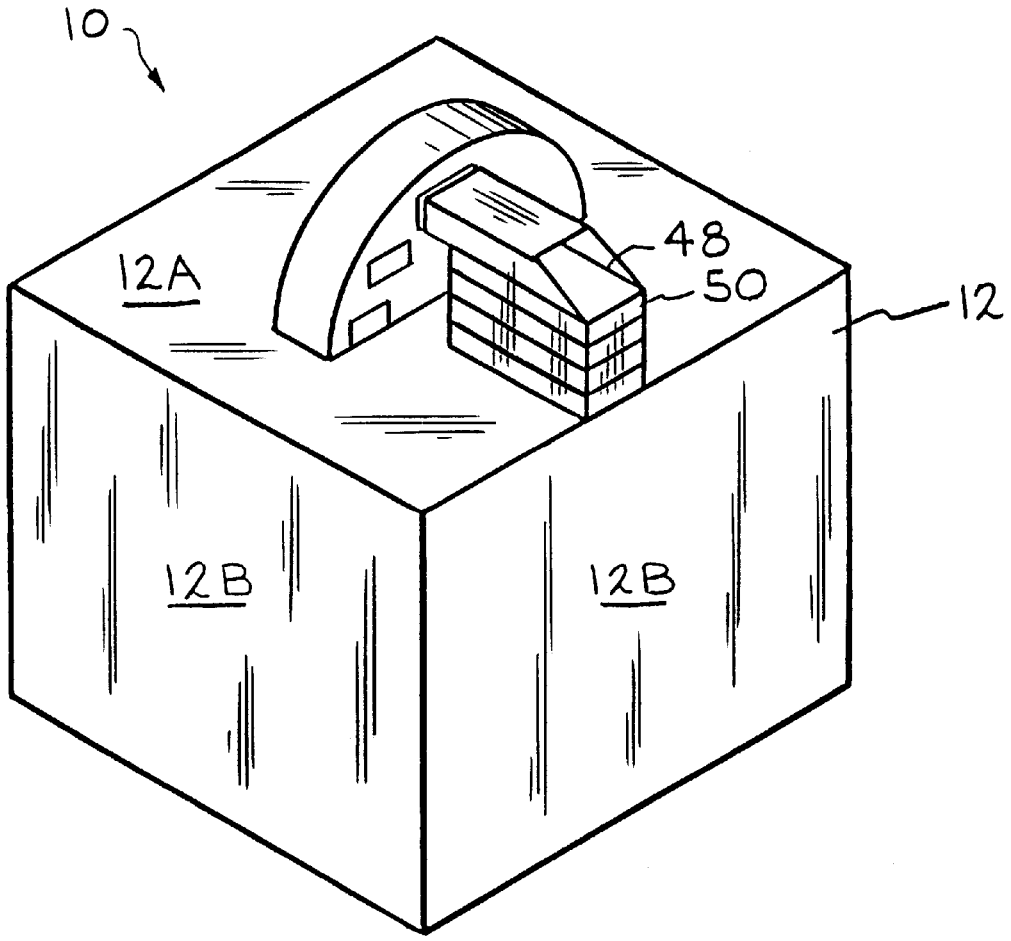
FIG. 1 is a perspective view of the fiberizing apparatus 10 of the present invention.
Figure 4A:
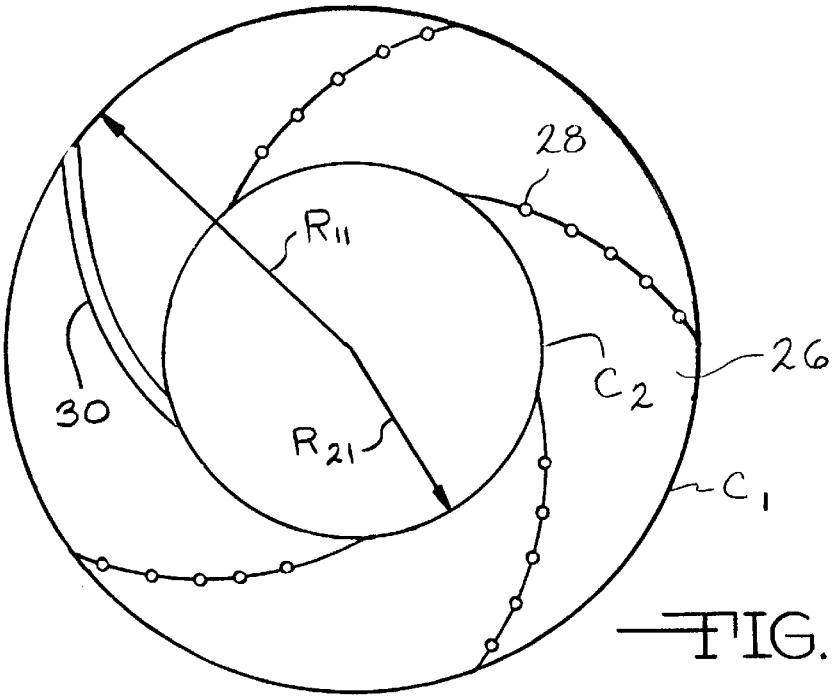
FIGS. 4A, 4B and 4C are front schematic views of three embodiments of the disc 26, 226 and 326 showing the positions, angles and radiuses for the teeth 28, 228 and 328 and scraper 30, 230 and 330.
Figure 5:
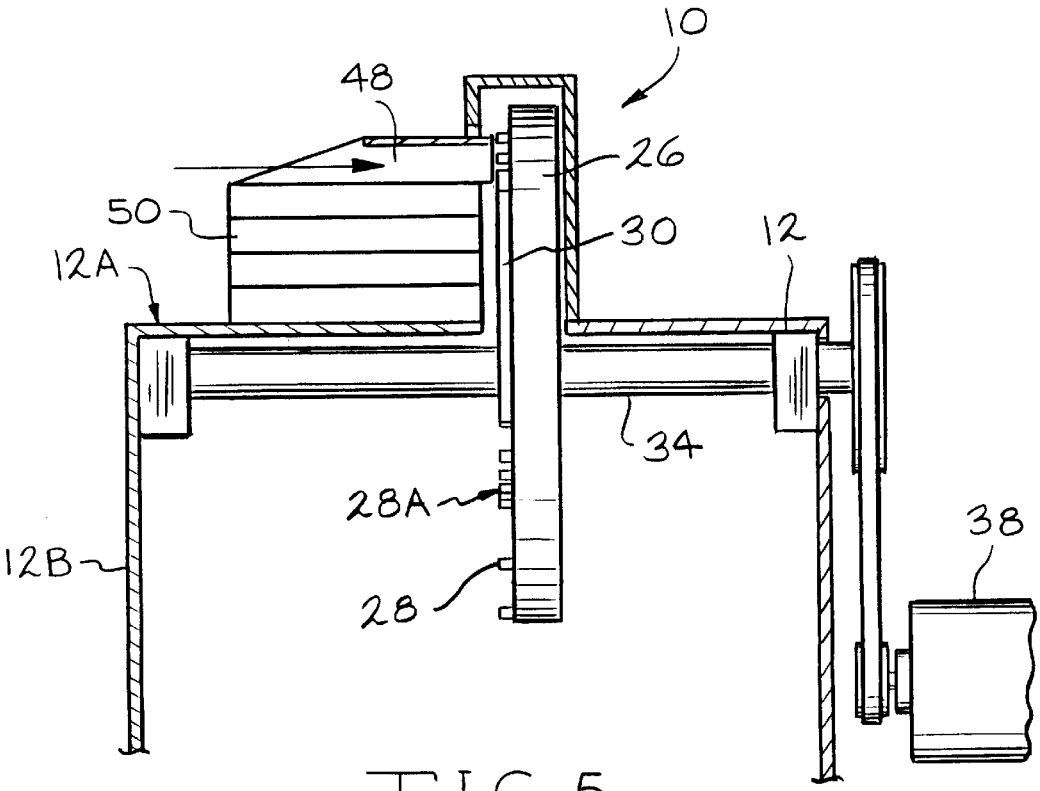
FIG. 5 is a cross-sectional side view of the fiberizing apparatus 10 showing the infeed chute 48, the segmented support 50, the disc 26 and the drive motor 38.
Figure 4B:
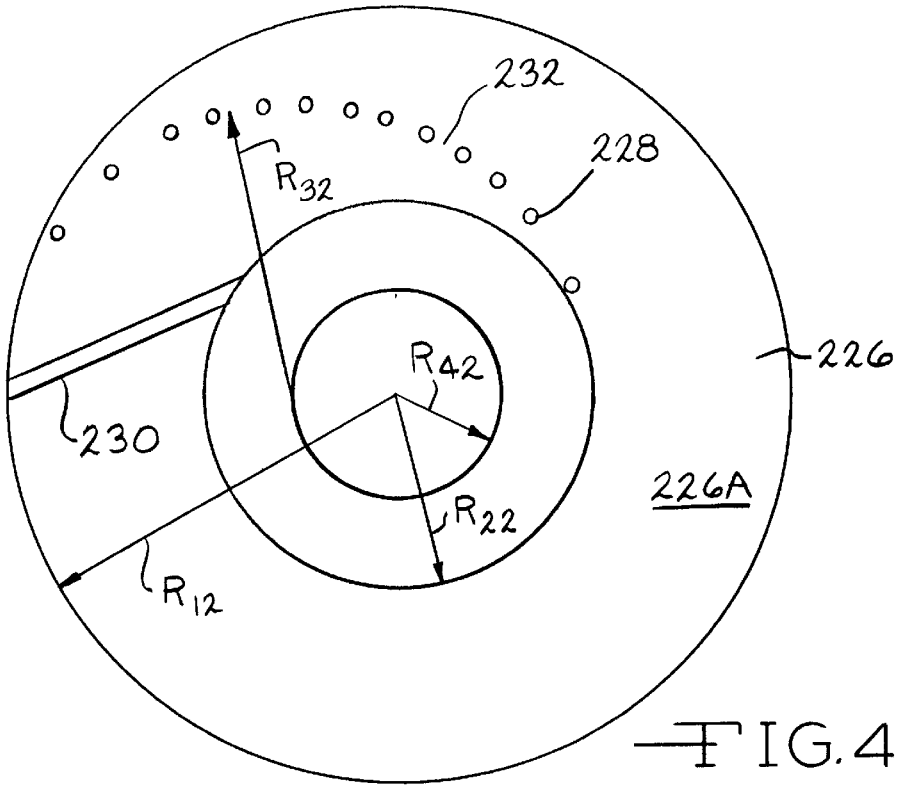
Figure 4C:
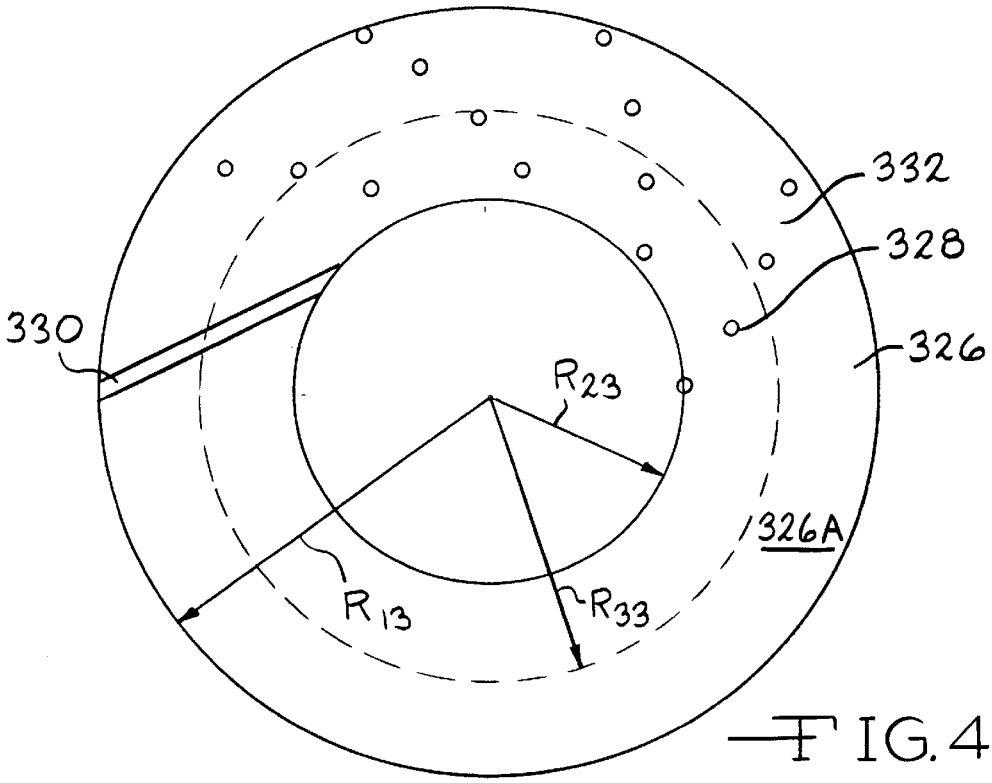

FIG. 1 shows the wood block fiberizing apparatus 10 of the present invention. The apparatus 10 includes a housing 12 within which is mounted a fiberizing disc 26, 226 or 326. The housing 12 has a top wall 12A and four side walls 12B. The fiberizing disc 26, 226 or 326 has a flat, planar face 26A, 226A or 326A which is provided with teeth 28, 228 or 328 and a scraper 30, 230 or 330 (FIGS. 4A, 4B and 4C). The teeth 28, 228 or 328 preferably have a cylindrical shape and are mounted on the planar face 26A, 226A or 326A of the disc 26, 226 or 326 such as to be perpendicular to the planar face 26A, 226A or 326A of the disc 26, 226 or 326. The teeth 28, 228 or 328 could also be inclined slightly forward. In the perpendicular orientation, the teeth 28, 228 or 328 separate the potential fibrous element from the wood block 100 by deflecting it more or less laterally in rolling shear which tends to produce a more curled fiber. In the inclined orientation, the teeth 28, 228 or 328 have a plowing action which adds an outward thrust and produces a more linear fiber. The number of teeth 28, 228 or 328, the spacing of the teeth 28, 228 or 328 and the number of rows 32, 232 or 332 of teeth 28, 228 or 328 are a function of the diameter of the teeth 28, 228 or 328 and diameter of the disc. However, in all cases, the teeth 28, 228 or 328 are arranged such that the teeth 28, 228 or 328 provide a complete sweep of the surface of the wood block 100 during a single rotation of the disc 26, 226 or 326. Both the diameter and the projection length of the teeth 28, 228 or 328 determine the nature of the fibrous element to be produced. The cutting end 28A, 228A or 328A of the teeth 28, 228 or 328 has either a pointed leading edge or a rounded leading edge. The rounded edge acts like a scraper to dislodge the fibrous element from the wood block 100, whereas the pointed edge acts like a chisel, splitting the wood ahead of it before pushing the wood aside. In both cases however, the edges of the teeth 28, 228 or 328 induce total and partial cleavages and rolling shear to extract the desired fibrous elements. The fibrous parts or appendages of the fibrous elements are created by partial cleavages when the failure zones are partly in the parent wood block 100 and partly in the main body or strand of the separating fibrous element. The cutting end 28A, 228A or 328A of the teeth 28, 228 or 328 is preferably provided with a clearance angle of between 5° to 10°. The scraper 30, 230 or 330 is positioned rearward of the rows 32, 232 or 332 of teeth 28, 228 or 328 so as to sever and propel fibrous elements outward and away from oncoming teeth 28, 228 or 328. The teeth 28, 228 or 328 and the scraper 30, 230 or 330 project the same distance from the planar face 26A, 226A or 326A of the disc 26, 226 or 326. The scraper 30, 230 or 330 has a length equal to the length of the rows 32, 232 or 332 of teeth 28, 228 or 328.

Preferably, in all the embodiments, the teeth 28, 228 or 328 extend outward from the planar face 26A, 226A or 326A of the disc 26, 226 or 326 a distance equal to their diameter and are constructed of hardened steel, or similar wear-resistant material or can be carbide tipped. The teeth 28, 228 or 328 can have a diameter in the range of 0.0625 inches to 0.50 inches (0.158 to 1.27 cm) with a projection length from the planar face 26A, 226A or 326A of the disc 26, 226 or 326 in the range of 0.03135 inch to about 0.375 inches (0.0794 to 0.953 cm). In all embodiments, the disc 26, 226 or 326 preferably has a thickness of 2.0 to 4.0 inches (5.1 to 10.2 cm) depending upon diameter and is constructed of steel.

Figure 2:
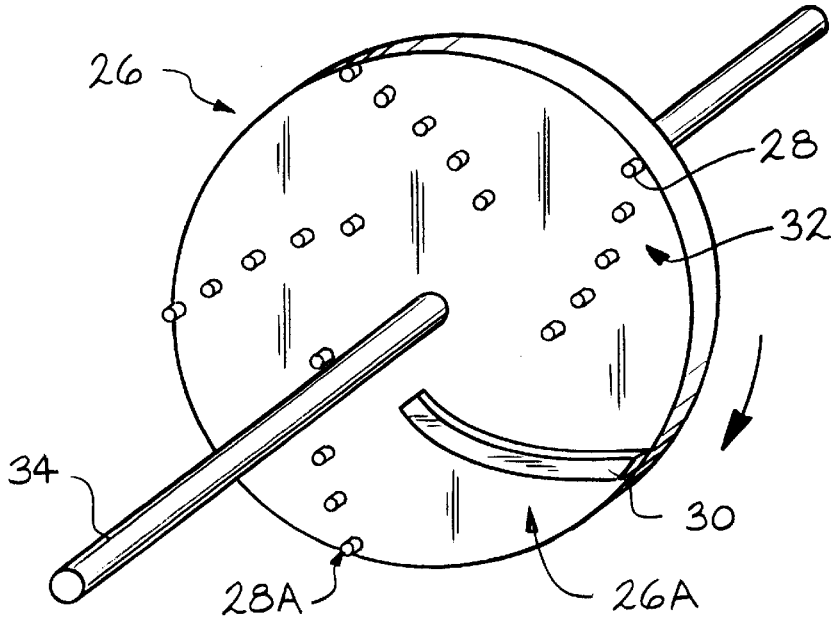
FIG. 2 is a perspective view of the fiberizing disc 26 on the rotation shaft 34 showing the teeth 28 and the scraper 30.
Figure 3:
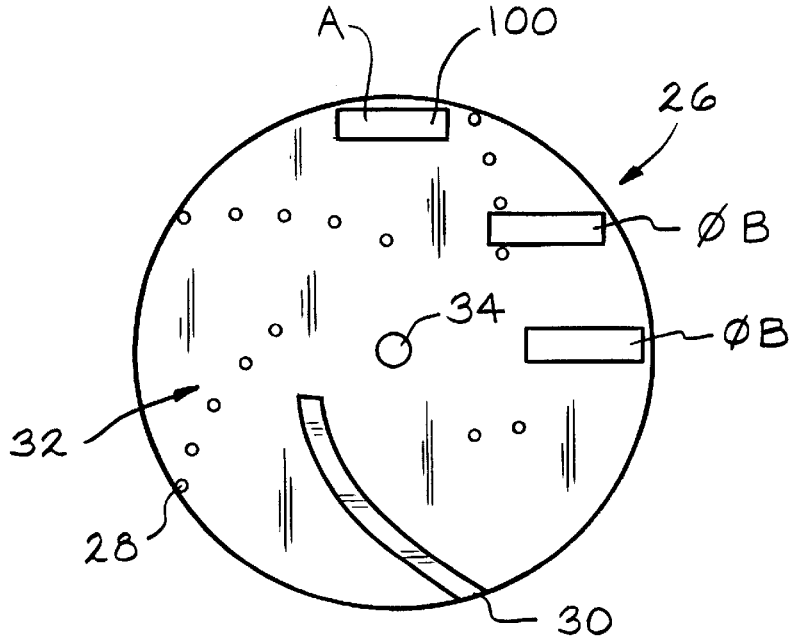
FIG. 3 is a front view of the disc 26 showing the different locations for placing the infeed chute 48 to vary the orientation of the wood block grain with respect to the circularly travelling teeth 28 to produce a different fibrous element.

In the first embodiment, as shown in FIGS. 2, 3 and 4A, the teeth 28 are provided in a series of rows 32 on the planar face 26A of the disc 26. The planar face 26A of the disc 26 is provided with four (4) rows 32 of teeth 28 and one (1) scraper 30. The number of rows 32 of teeth 28 depends on the width of each tooth 28. The number of teeth 28 in a row 32 depends on size of the disc 26. The size of the disc 26 depends primarily on the size of the wood blocks to be fiberized; although, larger discs 26 are preferred for the flatter tooth path they allow. In the first embodiment, the disc 26 has a diameter of 20.0 inches (50.8 cm) corresponding to a radius $R_{11}$ of 10.0 inches (25.4 cm) and a distance around the circumference $C_1$ of the disc 26 of 62.8 inches (159.6 cm) (FIG. 4A). The disc 26 will accept blocks 4.0 to 6.0 inches (10.2 to 15.2 cm) along the grain. A 48.0 inch (121.9 cm) disc 26 will accept wood blocks 100 up to about 12.0 inches (30.5 cm) in length along the grain. In the first embodiment, the teeth 28 have a diameter of 0.25 inch (0.64 cm) and four (4) rows 32 of teeth 28 are necessary to completely cover the wood block 100 surface. Four rows 32 with five (5) teeth 28 each provide a complete sweep of the surface of a wood block 100. In an alternate version of the first embodiment (not shown) with the disc having a diameter of 20.0 inch (50.8 cm) and the teeth having a diameter of 0.125 inch (0.318 cm), eight (8) rows of five (5) teeth each are needed to cover the face of the disc. The smaller the teeth 28, the finer the resulting fibrous element.

In the first embodiment having four (4) rows 32 of teeth 28 and one scraper 30, the rows 32 and scraper 30 are spaced 72° around the circumference of the disc 26 to provide equal spacing. The rows 32 of teeth 28 and the scraper 30 can have an arcuate shape with a radius equal to the radius $R_{11}$ of the disc 26. The rows 32 of teeth 28 are oblique rearward to the radii of the disc 26. The slope rearward is more important than the exact curvature. The rows 32 of teeth 28 and the scraper 30 are preferably deployed in an arcuate shape to increase the opportunity for individual action by each tooth 28 and to facilitate instant extraction of the severed fibrous elements. However, the rows 32 of teeth 28 and the scraper 30 may also be deployed along straight lines. This allows for easier design and maintenance of the disc 26. One locus of centers for scribing the rows 32 of teeth 28 and the scraper 30 is provided by a circle coaxial with the disc 26 and having a radius $R_{21}$ which is equal to one half of $R_{11}$ (FIG. 4A). Therefore, in the first embodiment, the radius $R_{21}$ of the center circle is 5.0 inches (12.7 cm).

In the first embodiment, every tooth 28 on the face 26A of the disc 26 is located a different distance from the center of the disc 26 and is located on a different radial angle. The actual deployment of each tooth 28 on the face 26A of the disc 26 follows the precept that each tooth 28 operate independently though cooperatively while engaged with the wood block 100. The positioning of the teeth 28 can be better understood by visualizing that if all the teeth 28 to be installed on one disc 26 were to be accumulated side-by-side on a single radius, the teeth 28 would provide a serrated edge and would be acting in concert and possibly jamming the system as they tried to bulldoze a layer off the wood block 100. However, by sequencing each tooth 28 rearward, a fixed distance (FIG. 4B), without deviating radially, each tooth 28 will enter the wood block 100 at a different time, thereby operating independently. Trailing teeth 28 cooperate by assisting in the extraction of fibrous elements begun by the advance teeth 28.

In the first embodiment, this long single row of teeth 28 is broken down into four (4) rows 32 as follows: the location of the teeth 28 and rows 32 is determined by scribing orbits at 0.25 inch (0.64 cm) intervals along the outer half of the radius $R_{11}$ of the disc 26 and then scribing arcs at 72° intervals with radius $R_{11}$ and centers on $C_1$ (FIG. 4A). The intersections of the arcs with the orbits mark the location of each tooth 28. The teeth 28 in each row 32 are then located by displacing every fourth tooth 28 from the accumulated radius back to the first arc beginning with the first tooth 28 at the periphery. The second arc will contain every fourth tooth still remaining an the accumulated radius beginning with the second tooth 28; and similarly for the remaining arcs and teeth 28. The fourth arc will terminate with the last tooth 28 on the accumulated radius and will generally be on the circle defined by $R_{21}$, but may be further inward if desired. The scraper 30 is mounted on the fifth arc. This arrangement allows each tooth 28 to function even more independently but still cooperatively in forming and expelling the fibrous elements, while at the same time still providing a complete sweep of the entire block surface during each rotation of the disc 26.

In the second and third embodiments (FIGS. 4B and 4C), the teeth 228 and 328 and the scraper 230 and 330 are clustered on only one half the facial area of the disc 226 and 326 within an angle of 180°. A similar protocol for deploying teeth 228 and 328 also applies to the second and third embodiments wherein all rows 232 and 332 are clustered on one half the disc 226 and 326 except the spacing of the rows is at 36° intervals. This arrangement allows the build-up of momentum during each revolution of the disc 226 and 326 to help carry the teeth 228 and 328 through the cut. The protocol for deploying teeth 228 and 328 produces one long row 232 or four (4) rows 332 of teeth 228 and 328 sloping rearward which sweep the entire face of the wood block 100 with each rotation of the disc 226 and 326. The scraper 230 and 330 is located on the same half of the disc 226 and 326 as the teeth 228 and 328 and can have a variety of different shapes.

In the second embodiment (FIG. 4B), the disc 226 has a radius $R_{12}$. The first tooth 228 is located a distance of $R_{22}$ from the center of the disc 226 where $R_{22}$ equals one half of $R_{12}$ ($R_{22}$=½ $R_{12}$). The row 232 of teeth 228 preferably extends across the entire half of the disc 226 where a last position marks the beginning of the scraper 230. In this protocol, the radius of the arc of the row 232 of teeth 228 is $R_{32}$ where $R_{32}$ equals three quarters of $R_{12}$ ($R_{32}$=¾ $R_{12}$). The center for the arc of row 232 of teeth 228 in the second embodiment is a distance of $R_{42}$ from the center of the disc 226 where $R_{42}$ equals one quarter of $R_{12}$ ($R_{42}$=¼ $R_{12}$).

In other embodiments (not shown), the single row of teeth 232 shown in FIG. 4B can also be extended to cover the entire circumference of the disc 226 by doubling the spacing between teeth 228 or by simply deploying two rows.

In the third embodiment, the same number of teeth 328 are arranged in four (4) rows 332 on one half of the disc 326 (FIG. 4C). The scraper 330 is located on the same half of the disc 326 as the rows 332 of teeth 328. The radius of the disc 326 is $R_{13}$. The first tooth 328 in the first row 332 is preferably located a distance of $R_{23}$ from the center of the disc 326 where $R_{23}$ equals one half of $R_{13}$ ($R_{23}$=½ $R_{13}$). The rows 332 of teeth 328 in this case have a radius of $R_{33}$ and are spaced 36° apart on one half of the disc 326. The loci of the rows 332 of teeth 328 are preferably at a distance of $R_{33}$ from the center of the disc 326 where $R_{33}$ equals three quarters of $R_{13}$ ($R_{33}$=¾ $R_{13}$).

This protocol for designing the location of rows 32, 232 and 332 and teeth 28, 228 and 328 applies to any size disc 26, 226 or 326. When the teeth 228 are deployed in a single row 232 (FIG. 4B), the maximum length fibrous element is obtained, whereas with multiple rows 32 or 332, the distance between the teeth 28 or 328 of the first row 32 or 332 influences the length of the fibrous element that will be produced.

In determining what radial portion of the disc 26, 226 or 326 to be studded with teeth 28, 228 or 328, the choice has geometric parameters. The most desirable fibrous strands are produced by teeth following the flattest curved path, i.e., the outermost path from the center of the disc 26, 226 or 326. Conversely, poorer strands are produced by teeth following the sharpest curved path, i.e., closer to the center. Therefore, it is desirable to address the wood block 100 as far away from the center as possible. Since a continuous quality gradient exists along the radius, the cut-off point for locating teeth 26, 226 or 326 is somewhat arbitrary. The midpoint of the radius is selected for the location of the innermost tooth 26, 226 or 326 to produce the best average quality fiber. Accordingly, the number of teeth 28, 228 or 328 to be deployed in the embodiments described is a function only of the half-radius of the disc 26, 226 or 326 and the diameter of the teeth 28, 228 or 328. As examples, the following chart summarizes the minimum tooth count for three (3) disc diameters and two (2) tooth sizes to provide a complete sweep of the wood block surface with each revolution of the disc 26, 226 or 326. These numbers hold whether the teeth 28, 228 or 328 are deployed in a single row or multiple rows 32, 232 or 332, and whether the rows 32, 232 or 332 are spaced equally around the disc 26, 226 or 326 or clustered on one side.

| Disc Diameter (inches) | Number of teeth 0.25 inch | Number of teeth 0.125 inch |
|---|---|---|
| 20 | 20 | 40 |
| 32 | 32 | 64 |
| 48 | 48 | 96 |

In all embodiments, the disc 26, 226 or 326 is fixably mounted on a shaft 34 which is rotatably mounted with bearings to a frame (not shown) within the housing 12. When mounted, half the disc 26, 226 or 326 extends above the housing 12 and is available for engaging the wood block 100. The shaft 34 can be driven either by electric motor 38 when operated indoors, or by gas engine (not shown) when operated in the field. The fibrous elements are discharged to a bin (not shown) but alternatively, can be collected by a belt or by air for transport to further processing. The housing 12 has an opening 46 adjacent the top of the disc 26, 226 or 326 at the planar face 26A, 226A or 326A of the disc 26, 226 or 326. An infeed chute 48 is mounted on the housing 12 adjacent the opening 46 in the housing 12 and the rotating disc 26, 226 or 326. The infeed chute 48 allows the wood blocks 100 to be fed into the apparatus 10. The infeed chute 48 holds the wood blocks 100 in precise position for fiberizing by the teeth 28, 228 or 328 on the disc 26, 226 or 326. The infeed chute 48 is preferably constructed of stackable supports 50 which allow the user to vary the position of the wood block 100 with respect to the path of the teeth 28, 228 or 328 on the rotating disc 26, 226 or 326. Adjusting the height and location laterally of the infeed chute 48 adjusts the angle at which the teeth 28, 228 or 328 engage the grain of the wood block 100. Any method of feeding wood blocks 100 to the disc 26, 226 or 326 may be used provided the block 100 is held in position and in proper alignment during fiberizing.

IN USE

The apparatus 10 is used to comminute solid wood blocks 100 to produce fibrous elements which are useful in making composite products. To operate the apparatus 10, the infeed chute 48 is adjusted to the correct position as determined by the user for the specific form or configuration of fiberized element to be produced. The wood blocks 100 would have previously been cut to the correct length as determined by the size of the infeed chute 48. Once the apparatus 10 is correctly configured, the disc 26, 226 or 326 is activated and the wood block 100 is then placed flatwise into the infeed chute 48 and moved into contact with the teeth 28, 228 or 328 of the disc 26, 226 or 326 for continuous fiberizing. The wood block 100 is positioned such that the teeth 28, 228 or 328 of the disc 26, 226 or 326 engages the side grain surface of the wood block 100.

As shown in FIG. 3, the location of the infeed chute 48 can be chosen to provide the desired grain orientation for the circulating teeth 28, 228 or 328 to change the configuration, form or nature of fibrous elements produced from the wood block 100. The first orientation A produces the longest fibrous elements. Orientation C produces the shortest elements and Orientation B produces intermediate lengths. The most useful fibers are produced when the teeth 28, 228 or 328 are advancing through the wood block 100 essentially in the long direction of the grain.

As the teeth 28, 228 or 328 engage the wood block 100, the teeth 28, 228 or 328 plow through the surface layer of the wood block 100 and form fibrous elements. Once formed, fibrous elements are separated from the wood block 100 either by further action of the teeth 28, 228 or 328 or by the scraper 30, 230 or 330. The arrangement of the teeth 28, 228 or 328 in arcuate rows 32, 232 or 332 helps to facilitate the ejection of fibrous elements as quickly after the fibrous element has been formed as possible to avoid further breakdown or cutting of fibrous elements. The scraper 30, 230 or 330 acts to sweep the surface of the wood block 100 clean and remove any partially formed fibrous elements which have not been fully removed by the teeth 28, 228 or 328. As the disc 26, 226 or 326 rotates, the teeth 28, 228 or 328 mare different circular paths along the surface of the wood block 100. Each tooth 28, 228 or 328 is on a different radius and circumference and thus, cuts or gouges its own circular path through the surface of the wood block 100. Adjacent paths cut by the teeth 28, 228 or 328 are further cut or gouged by trailing teeth 28, 228 or 328. Each tooth 28, 228 or 328 is offset a distance equal to its diameter in succeeding rows 32, 232 or 332 to provide a complete sweep of the surface of the wood block 100 during each rotation of the disc 26, 226 or 326. The arrangement of teeth 28, 228 or 328 allows a fibrous element formed by one tooth 28, 228 or 328 to be further cut or gouged by subsequent teeth 28, 228 or 328 until the fibrous element is completely formed and is severed from the wood block 100. The arrangement of teeth 28, 228 or 328 also results in less than one half of the teeth 28, 228 or 328 being engaged in the wood block 100 at any one time which minimizes the power necessary to fiberize the wood block 100. The circular path of the teeth 28, 228 or 328 through the wood block 100 provides a deliberate, across the grain force component, which promotes the differential shear necessary for producing fibrous projections in the main part of the fibrous element. The apparatus 10 eliminates the need to first reduce the wood block 100 to chips prior to producing the usable fibrous elements as is necessary in conventional wood fiberizing processes.

The primary, controllable variables that affect the form or nature of the fibrous elements are the configuration and size of the teeth 28, 228 or 328, the location and spacing of the teeth 28, 228 or 328 and the distance the teeth 28, 228 or 328 extend outward from the surface 26A, 226, or 326A of the disc 26, 226 or 326. Teeth 28, 228 or 328 having a smaller diameter produce fairly fine fibrous elements while teeth 28, 228 or 328 having a larger diameter and protruding from the planar face 26A, 226A or 326A of the disc 26, 226 or 326 a distance at least equal to their diameter produce a coarse fibrous element. The circular path of the teeth 28, 228 or 328 over the relatively straight grain of the wood block 100 ensures that a rolling, shearing action provides the primary force for forming and separating fibrous elements from the wood block 100. The fiberizing apparatus 10 can be used to produce fibrous elements from a variety of types of wood irrespective of form, size or species. Thus, encouraging the use of unwanted or waste wood and thereby increasing our wood supply while promoting more forest management options that favor the environment. Some of the species of wood include oak, maple, willow, spruce, pine and cherry. Better fiberizing occurs with wood at high moisture content; however, some low density species can be fiberized in the dry condition although with some loss of yield.

Once fibrous elements are formed, the elements fall down and away from the wood block 100 and into a bin. The fibrous elements can be used for a variety of purposes, such as in bulk uses such as animal bedding soil stabilization and oil spill pickup or reaggragations with organic, inorganic or waste plastic binders for use in producing composite materials such as for paneling or for use in containers.

It is intended that the foregoing description be only illustrative of the present invention and that many refinements and other embodiments can be derived therefrom by those knowledgeable in the field and that the present invention be limited only by the herainafter appended claims.

I claim:

1. An improved disc for comminuting a wood block to produce fibrous elements having a planar face and journaled for rotation, the improvement which comprises:

(a) a plurality of teeth having a cylindrically shaped cutting end and protruding from the planar face of the disc which engage and plow through a surface of the wood block to induce total and partial cleavages on the surface of the wood block to produce fibrous elements, the teeth arranged in at least one row on the planar face of the disc; and (b) a scraper positioned on the planar face of the disc so as to remove fibrous elements from the surface of the wood block.

2. The disc of claim 1 wherein the teeth are arranged in one or more rows which are oblique rearward to the radii of the disc.

3. The disc of claim 2 wherein the teeth in each row are incrementally spaced apart.

4. The disc of claim 3 wherein each tooth in the row is positioned on a different radius such that a total sweep of the surface of the wood block is achieved during each rotation of the disc.

5. The disc of claim 1 wherein the teeth have a round cross-section and wherein a cutting end of the teeth has a round leading edge.

6. The disc of claim 1 wherein the teeth have a round cross-section and wherein a cutting and of the teeth has a pointed leading edge.

7. The disc of claim 1 wherein the row of teeth have an arcuate shape.

8. The disc of claim 1 wherein the scraper is oriented obliquely with the radii.

9. The disc of claim 1 wherein the teeth are located on one half of the planar face of the disc.

10. The apparatus of claim 1 wherein the teeth are positioned on the planar face to provide a complete sweep of the surface of the wood block with each rotation of the disc.

11. An apparatus which comprises:

(a) a rotatable disc with a planar face which is journaled for rotation and having teeth with a cylindrically shaped cutting end and extending from the planar face which engage and plow through a surface of a wood block in a circular path to induce total and partial cleavages on the surface of the wood block to produce fibrous elements as the disc rotates with the teeth arranged in at least one row on the planar face of the disc and having a scraper which sweeps fibrous elements from the surface of the wood block; and (b) feed means mounted adjacent the rotatable disc which directs the wood block against the face of the disc so that the teeth engage the surface of the wood block in a circular path.

12. The apparatus of claim 11 wherein the teeth have a cylindrical shape and extend outward from the planar face of the disc about 0.031 to 0.375 inches (0.0788 to 0.953 cm).

13. The apparatus of claim 11 wherein the feed means is movable vertically and horizontally with respect to the planar face of the disc so as to change a direction of the grain of the wood block with respect to the circular path of the teeth to change a nature of fibrous elements.

14. The apparatus of claim 11 wherein the teeth of the disc are arranged in one or more rows around the planar face of the disc.

15. The apparatus of claim 14 wherein the rows of the teeth have an arcuate shape.

16. The apparatus of claim 11 wherein the teeth are located on one half of the planar face of the disc.

17. The apparatus of claim 11 wherein the scraper is positioned rearward of the rows of teeth so as to sever and propel fibrous elements outward and away from oncoming teeth.

18. The apparatus of claim 11 wherein the teeth are positioned on the planar face to provide a complete sweep of the surface of the wood block with each rotation of the disc.

19. A method for producing fibrous elements from wood blocks, which comprises:

(a) providing an apparatus which comprises: a rotatable disc with a planar face which is journaled for rotation and having teeth with a cylindrically shaped cutting end and extending from the planar face which engage and plow through a surface of a wood block in a circular path to produce fibrous elements as the disc rotates, the teeth arranged in at least one row on the planar face of the disc and having a scraper which sweeps fibrous elements from the surface of the wood block; feed means mounted adjacent to the rotating disc which directs the wood block against the face of the disc so that the teeth engage the surface of the wood block in a preset manner; and (b) introducing the wood block into the apparatus so that the surface of the block engages the teeth on the planar face of the disc with the teeth moving in a circular path on a preset grain direction of the wood block to induce total and partial cleavages on the surface of the wood block to produce fibrous elements and the scraper engages the surface of the wood block to remove fibrous elements from the wood block.

20. The method of claim 19 wherein the feed means is adjustable such that orientation of the grain of the wood block is varied with respect to the circular path of the teeth to change a nature of fibrous elements.

* * * * *

UNITED STATES PATENT AND TRADEMARK OFFICE

CERTIFICATE OF CORRECTION

PATENT NO. : 5,904,304

DATED : May 18, 1999

INVENTOR(S) : Alan A. Marra and Vic Marra

It is certified that error appears in the above-identified patent and that said Letters Patent is hereby corrected as shown below:

In Figure 3, the middle wood block "ØB" should be --B--.

In Figure 3, the lower wood block "ØB" should be --C--.

Column 1, line 46, "planes" should be --plane--.

Column 2, line 7, "driven ever" should be --driven over--.

Column 4, line 28, "row an the" should be --row on the--.

Column 6, line 55, "remaining an the" should be --remaining on the--.

Column 7, lines 62 and 64, teeth 26, 226, or 326, should be --teeth 28, 228, 328--.

Column 9, line 18, "mare" should be --make--.

Column 9, line 48, "26A, 226, or 326A" should be --26A, 226A, or 326A--.

UNITED STATES PATENT AND TRADEMARK OFFICE

CERTIFICATE OF CORRECTION

PATENT NO. : 5,904,304

DATED : May 18, 1999

INVENTOR(S) : Alan A. Marra and Vic Marra

It is certified that error appears in the above-identified patent and that said Letters Patent is hereby corrected as shown below:

Column 10, line 5, "reaggragations" should be --reaggregations--.

Column 10, line 39 (Claim 6), "cutting and" should be --cutting end--.

Signed and Sealed this

Thirtieth Day of May, 2000

*Attest:*

Q. TODD DICKINSON

*Attesting Officer*

*Director of Patents and Trademarks*